US006931222B2

(12) United States Patent
Okada

(10) Patent No.: US 6,931,222 B2
(45) Date of Patent: Aug. 16, 2005

(54) METHOD OF AND APPARATUS FOR DERIVING INFORMATION, ELECTRIC APPLIANCE, IMAGE FORMATION APPARATUS, AND COMPUTER PRODUCT

(75) Inventor: Norikazu Okada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/464,671

(22) Filed: Jun. 19, 2003

(65) Prior Publication Data

US 2004/0022550 A1 Feb. 5, 2004

(30) Foreign Application Priority Data

Jun. 19, 2002 (JP) ..... 2002-179119
Apr. 25, 2003 (JP) ..... 2003-122747

(51) Int. Cl.[7] ..... G03G 15/00
(52) U.S. Cl. ..... 399/88; 323/282
(58) Field of Search ..... 399/33, 67, 69, 399/88, 282; 219/216, 501; 323/282

(56) References Cited

U.S. PATENT DOCUMENTS 5,802,421 A * 9/1998 Miura ..... 399/33
5,994,671 A * 11/1999 Suzuki et al. ..... 219/216
6,111,230 A * 8/2000 Cao et al. ..... 219/501
6,157,010 A * 12/2000 Mine ..... 219/501

FOREIGN PATENT DOCUMENTS

JP 8-308215 11/1996
JP 2002-268450 9/2002

* cited by examiner

*Primary Examiner*—Hoan Tran
(74) *Attorney, Agent, or Firm*—Oblon, Spivak, McClelland, Maier & Neustadt, P.C.

(57) ABSTRACT

An AC power source supplies power to a switching power source and a fixing heater. A power source waveform detecting circuit obtains a voltage waveform of the AC power source at a predetermined timing after the main power switch is turned on. A processor derives zero crossing information concerning zero crossing such as a zero crossing point based on the obtained voltage waveform. The processor controls power supply to the fixing heater based on the derived zero crossing information.

26 Claims, 13 Drawing Sheets

| FIG. 3A |
| --- |
| FIG. 3B |

TOP WAVEFORM: ZERO CROSSING SIGNAL

BOTTOM WAVEFORM: POWER SOURCE VOLTAGE

METHOD OF AND APPARATUS FOR DERIVING INFORMATION, ELECTRIC APPLIANCE, IMAGE FORMATION APPARATUS, AND COMPUTER PRODUCT

BACKGROUND OF THE INVENTION

1. Field of the Invention

The present invention relates to deriving information about an AC power source in an image formation apparatus.

2. Description of the Related Art

A zero crossing signal indicates a half-wave switching timing of an AC voltage waveform, and is used for a phase control and the like. An electric appliance to which a power is supplied from an AC power source, such as an image formation apparatus, uses the zero crossing signal in order to control turning on/off of a fixing heater. Conventionally, the following methods are widely used as a method of generating the zero crossing signal that is used for such control:

(1) A method of generating a zero crossing signal by a zero crossing signal detecting circuit that is a combination of a rectification circuit and a photocoupler;

(2) A method of generating a zero crossing signal by a zero crossing signal detecting circuit that is a combination of a transformer and a photocoupler.

In the image formation apparatus, the zero crossing signal is generated at the zero crossing signal detecting circuit, and sent to a controller such as a CPU. Upon receiving the zero crossing signal, the controller generates an interruption. Then, in the interruption processing, the controller controls turning on/off of the fixing heater for every half cycle of a power source frequency.

Specifically, at a time when the zero crossing signal is input, the controller generates a signal for turning off a triac that is a device turning on/off the fixing heater, that is, a signal for turning off the fixing heater. The controller further starts a timer, and generates a timer interruption in a few milliseconds after the time of the zero crossing signal input. When the timer interruption signal is generated, the controller generates, within the timer interruption, a signal for turning on the triac, that is, a signal for turning on the fixing heater.

In the image formation apparatus, the controller generates an interruption by using the zero crossing signal in this manner, and turns on and off the triac, thereby to control the turning on/off of the fixing heater.

In order to carry out the phase control of the fixing heater in the image formation apparatus, the zero crossing signal must be detected beforehand. Therefore, the image formation apparatus decides whether the zero crossing signal is detected in the initialization processing immediately after the power source of the image formation apparatus is turned on.

Specifically, in the zero crossing detection processing, when the controller generates a zero crossing interruption, the image formation apparatus decides that the zero crossing signal is generated. On the other hand, when the controller does not generate the zero crossing interruption, the image formation apparatus decides that the zero crossing signal is not generated. In this case, the image formation apparatus displays on an operation unit that the zero crossing signal is not generated. Furthermore, the image formation apparatus starts a one-second interruption timer, and counts the number of zero crossing interruptions generated until the next timer starts to count up to decide whether the power source frequency is 50 Hz or 60 Hz. For example, when the timer counts 45 to 54 times of zero crossing interruptions, the image formation apparatus decides that the power source frequency is 50 Hz, and when the timer counts 55 to 64 times of zero crossing interruptions, the image formation apparatus decides that the power source frequency is 60 Hz. On the other hand, when the timer counts 0 to 44 times or more than 64 times of zero crossing interruptions, the image formation apparatus displays on the operation unit that the zero crossing signal is erroneously detected.

As explained above, an electric appliance such as the image formation apparatus carries out control by using a zero crossing signal. Therefore, when the zero crossing signal is erroneously detected, the electric appliance becomes malfunctioning, thus it is necessary to prevent the occurrence of the abnormal detection. However, when the zero crossing signal detecting circuit generates the zero crossing signal by constantly monitoring the voltage waveform of the AC power source as with the methods (1) and (2), the zero crossing signal is detected erroneously when the power source voltage waveform is disturbed for some reason.

For example, when the AC power source voltage varies as shown at the bottom of the graph in FIG. 14, a zero crossing is detected at a time when the power source voltage is disturbed due to a noise or the like. As a result, a zero crossing signal is generated as shown at the top of the graph in FIG. 14.

When the image formation apparatus is used in the environment where a power source of a private power generator is used or in the environment where a number of large-power apparatuses are used, there has been a problem that a noise affects the power source, and a zero crossing is detected erroneously. In this case, since the detection of the power source frequency cannot be performed normally with an error message displayed, it is not possible to use the image formation apparatus.

To cope with the problem, when the image formation apparatus is used in the noisy environment, a technique has been proposed such that a power source frequency used in the image formation apparatus is obtained from a user, without carrying out a processing of detecting the power source frequency. Then, the obtained power source frequency from the user is stored in a ROM as a fixed frequency, and the ROM is fitted to the image formation apparatus.

Another method proposed to reduce such an erroneous detection of the zero crossing signal is that a zero crossing timing is decided based on conditions whether a time during which a power source voltage is within a predetermined range (i.e., a range around zero) is longer than a set value and whether the polarity of the power source voltage before entering the range is inverted after exiting the range (for example, refer to Japanese Patent Application Laid-open Publication No. 8-308215).

There is also a proposed technique of generating a zero crossing signal by detecting a starting point and an ending point of a half-wave of a voltage waveform that is supplied from the AC power source (for example, refer to Japanese Patent Application Laid-open Publication No. 2002-268450).

When using the technique of storing the power source frequency information in a ROM, however, the information stored in the ROM is not always correct, and the power source frequency may vary depending on the environment. In this case, it is not possible to accurately detect the zero crossing point.

Likewise, when using the technique of deciding whether the obtained voltage satisfies a predetermined condition (refer to Japanese Patent Application Laid-open Publication No. 8-308215) and the technique of detecting a starting point and an ending point of a half-wave (refer to Japanese Patent Application Laid-open Publication No. 2002-268450), although it is possible to exclude the influence of the noise, the voltage waveform must always be monitored, which increases a processing load.

SUMMARY OF THE INVENTION

It is an object of the present invention to solve at least the problems in the conventional technology.

The information deriving apparatus according to one aspect of the present invention includes a waveform obtaining unit that obtains a voltage waveform of an AC power source at a predetermined timing; and a deriving unit that derives zero crossing information based on a voltage waveform obtained.

The electric appliance according to another aspect of the present invention includes a load unit; a waveform obtaining unit that obtains a voltage waveform of an AC power source that supplies power to the load unit at a predetermined timing; a deriving unit that derives zero crossing information based on the voltage waveform obtained; and a control unit that controls the power supply from the AC power source to the load unit based on the zero crossing information.

The image formation apparatus according to still another aspect of the present invention includes an image transfer unit that transfers an image to a recording medium; a fixing unit that heats and fixes the image transferred by the image transfer unit; a waveform obtaining unit that obtains a voltage waveform of an AC power source that supplies power to the load unit at a predetermined timing; a deriving unit that derives zero crossing information based on the voltage waveform obtained; and a control unit that controls the power supply from the AC power source to the load unit based on the zero crossing information.

The image formation apparatus according to still another aspect of the present invention includes an image transfer unit that transfers an image to a recording medium; a fixing unit that receives a power from an AC power source, and heats and fixes the image transferred by the image transfer unit; and a switching power source that rectifies an AC voltage from the AC power source to generate a plurality of DC voltages, wherein the switching power source includes a waveform obtaining unit that obtains a voltage waveform of an AC power source at a predetermined timing; a deriving unit that derives zero crossing information based on the voltage waveform obtained.; and a control unit that controls the power supply from the AC power source to the fixing unit based on the zero crossing information.

The information deriving method according to still another aspect of the present invention includes obtaining a voltage waveform of an AC power source at a predetermined timing; and deriving zero crossing information based on the voltage waveform obtained.

The computer program according to still another aspect of the present invention makes a computer execute obtaining a voltage waveform of an AC power source at a predetermined timing; and deriving zero crossing information based on the voltage waveform obtained.

The other objects, features and advantages of the present invention are specifically set forth in or will become apparent from the following detailed descriptions of the invention when read in conjunction with the accompanying drawings.

BRIEF DESCRIPTION OF THE DRAWINGS

FIG. 5 is a flowchart illustrating an initial sequence of a power supply control operation that the image formation apparatus carries out when a main power switch is turned on;

FIG. 6 is a flowchart illustrating a continuing sequence of the power supply control operation that the image formation apparatus carries out when the main power switch is turned on;

FIG. 7 is a flowchart illustrating a final sequence of the power supply control operation that the image formation apparatus carries out when the main power switch is turned on;

DETAILED DESCRIPTION

Exemplary embodiments of an information deriving apparatus, an electric appliance, an image formation apparatus, an information deriving method, and a program according to the present invention are explained in detail below with reference to the accompanying drawings.

Figure 1:
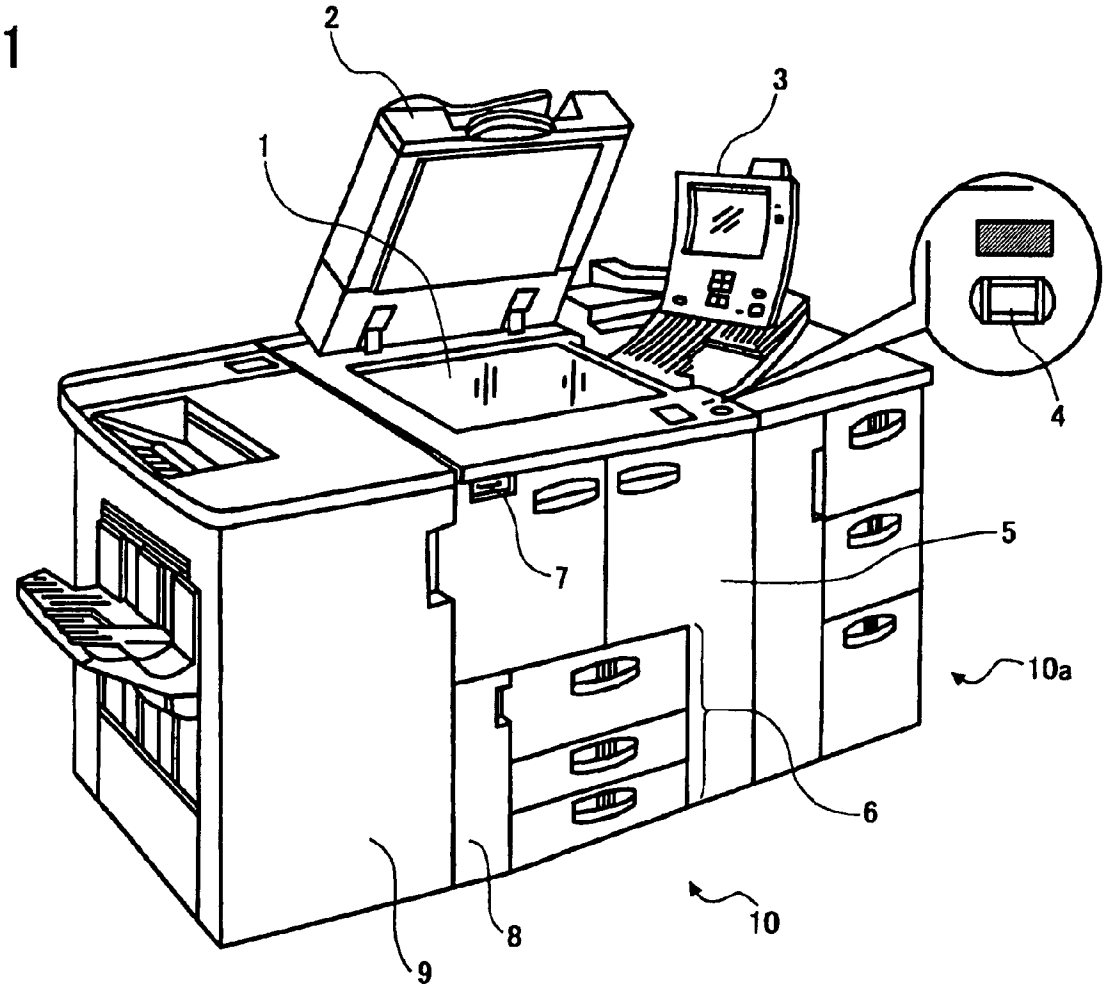
FIG. 1 is an outline view of an appearance of an image formation apparatus according to an embodiment of the present invention.

FIG. 1 shows is an outline view of an image formation apparatus according to an embodiment of the present invention. As shown in FIG. 1, the image formation apparatus includes a main body 10 that carries out a copying operation, a large-capacity paper feeder 10*a* that accommodates a large amount of paper or the like, and supplies the paper or the like to the main body 10, and a finisher 9 that sorts, punches, and files the copied paper or the like.

The main body 10 has an automatic document supplier 2 on the top, wherein the automatic document supplier 2 can be opened and closed. The automatic document supplier 2 conveys a document that is set thereon onto a contact glass 1 so that a scanner passes through a scanning position. The scanner can also read the document by setting the document on the contact glass 1 that is provided on the main body 10.

On the main body 10, an operating unit 3 is provided with a display panel that displays various kinds of information to a user, and an interface such as a button that the user presses to input various kinds of instructions. Further, a main power switch 7 for turning on and off the main power of the image formation apparatus is also provided on the main body 10.

When the user turns on the main power switch 7, the image formation apparatus starts operating. When the user turns off the main power switch 7, it stops power supply from a commercial power source to the image formation apparatus, thereby stops the operation of the image formation apparatus.

A power supply sub-key 4 is provided on the main body 10. When the user operates the power supply sub-key 4, it switches the image formation apparatus to an energy saving mode. When the user operates the power source sub-key 4 in the energy saving mode, the image formation apparatus returns to the normal operation mode.

A front cover 5 and a toner cover 8 are provided on the front side of the main body 10. At the time of carrying out maintenance or exchanging parts, it is possible to open the front cover 5 and the toner cover 8. Paper feeding trays 6 are provided in the main body 10. The image formation apparatus forms images on recording mediums such as a paper or an overhead projector (OHP) sheet accommodated in the paper feeding trays 6.

Figure 2:
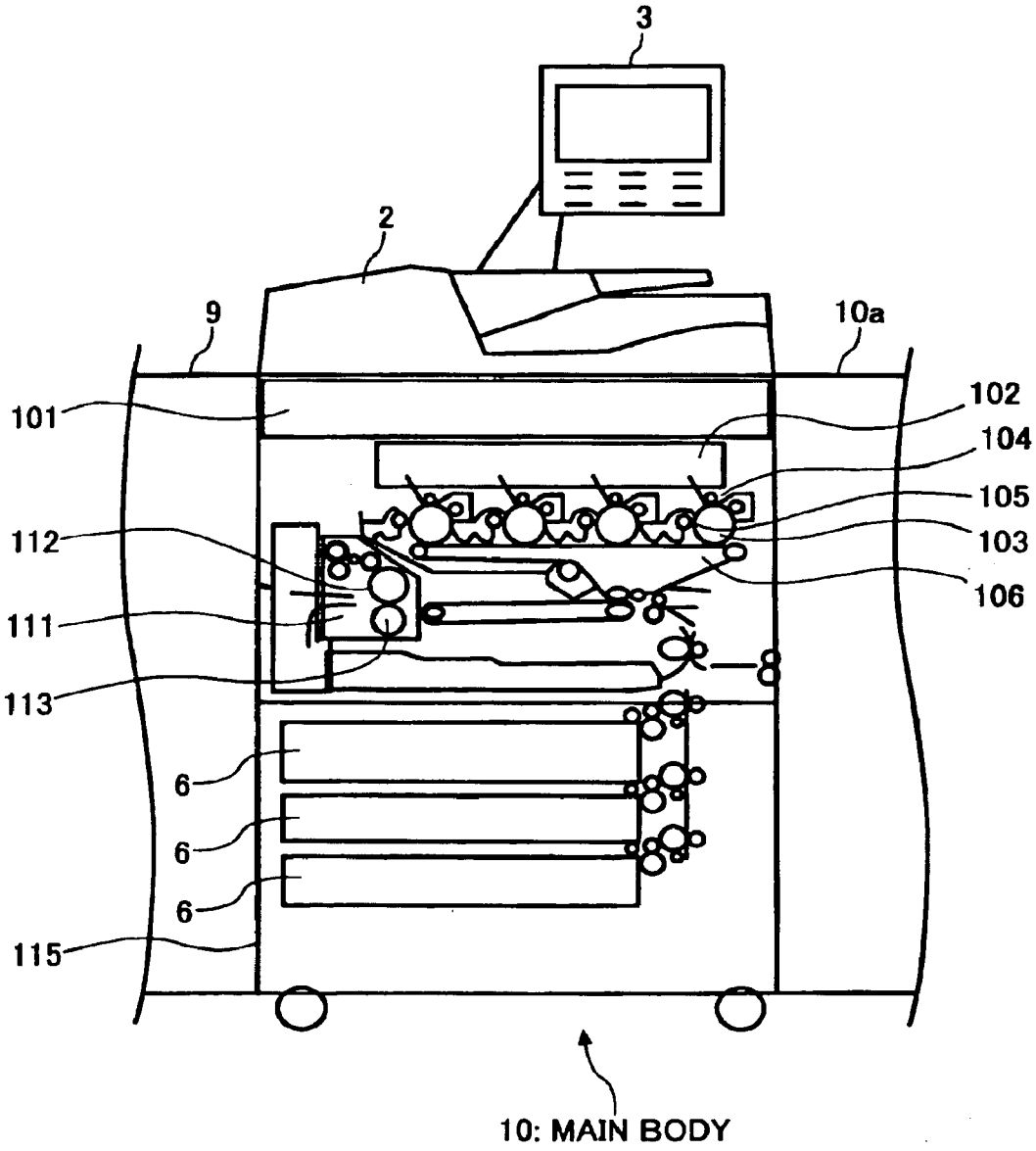
FIG. 2 is a schematic diagram of the image formation apparatus.

As shown in FIG. 2, the main body 10 includes a scanner 101, a writing unit 102, photo conductor drums 103, charging units 104, developing units 105, an image transfer unit 106, a paper feeding unit 115, and fixing units 111.

The scanner 101 is disposed at the upper part of the main body 10. The scanner 101 irradiates a light onto a document that is set on the contact glass 1 provided above the scanner 101. The scanner 101 converts the light reflected from the document into an electrical signal, thereby to read an image from the document. The scanner 101 also reads an image from the document that the automatic document supplier 2 passes through on the contact glass 1.

The writing unit 102 irradiates a laser beam corresponding to the image on the document read by the scanner 101, and projects the image onto each photo conductor drum 103.

The image formation apparatus according to the present embodiment can form color images based on an electrophotographic system, and has the photo conductor drums 103 corresponding to four colors of cyan (C), magenta (M), yellow (Y), and black (Bk) respectively. The charging units 104 are disposed around the photo conductor drums of corresponding colors, and charge these photo conductor drums. The developing units 105 transfer toners onto the photo conductor drums on which the writing unit 102 forms latent images. To avoid complexity of the drawing, only one reference numeral is attached to each unit such as the photo conductor drum corresponding to one color.

The image transfer unit 106 has a transfer belt that conveys paper along left and right directions in the drawing as a layout direction of the photo conductor drums 103 corresponding to the respective colors. The transfer belt conveys the paper to each transfer position of each photo conductor. Based on this, each photo conductor drum transfers the image of the corresponding color onto the paper at this transfer position.

The paper feeding unit 115 has a plurality of the paper feeding trays 6. At a time of copying, the paper feeding unit 115 takes out paper of a predetermined size from a corresponding paper feeding tray, and feeds the paper to the image transfer unit 106. The image transfer unit 106 conveys the paper to the transfer position, and transfers the image onto the paper.

Each fixing unit 111 fixes a toner on the recording medium such as a paper. This toner forms the image transferred by heating and pressing the recording medium. The fixing unit 111 has a fixing roller 112, and a pressure roller 113. A fixing heater is disposed in the hollow of the fixing roller 112 having a cylindrical shape. Power is supplied to each fixing heater to make the fixing heater generate heat. Based on this, the fixing heater increases the temperature on the surface of the fixing roller 112. The fixing heater may be disposed in the hollow of the fixing roller 112, or may be disposed at other position where the fixing heater can heat to enable the fixing unit 111 to operate. For example, the fixing heater may be disposed in the hollow of the pressure roller 113.

When the paper having the toner image transferred is passed through between the fixing roller 112 of which surface temperature is increased to at least a predetermined temperature and the pressure roller 113, the image is fixed on the paper.

Figures 3, 3A:
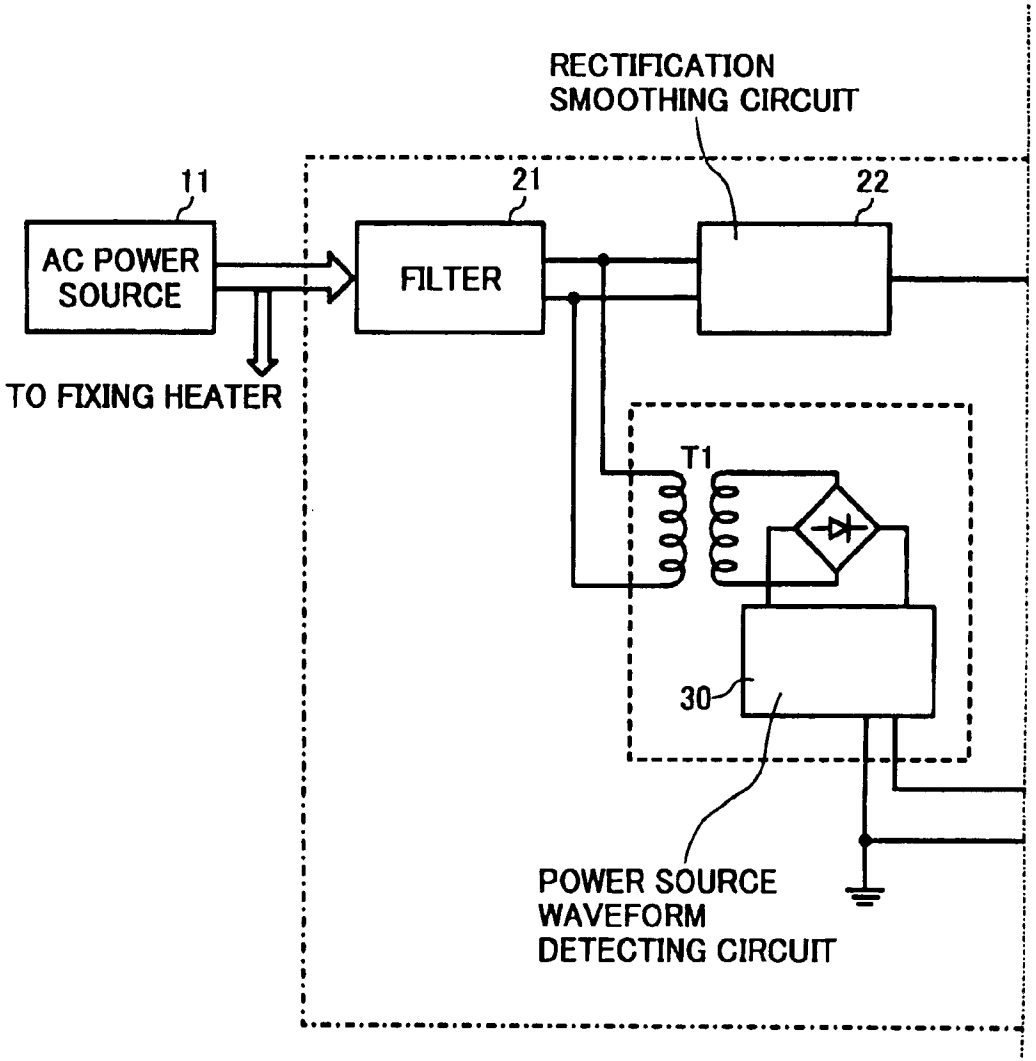
FIGS. 3A and 3B are block diagrams representing a power supply to a fixing heater in the image formation apparatus.
Figure 3B:
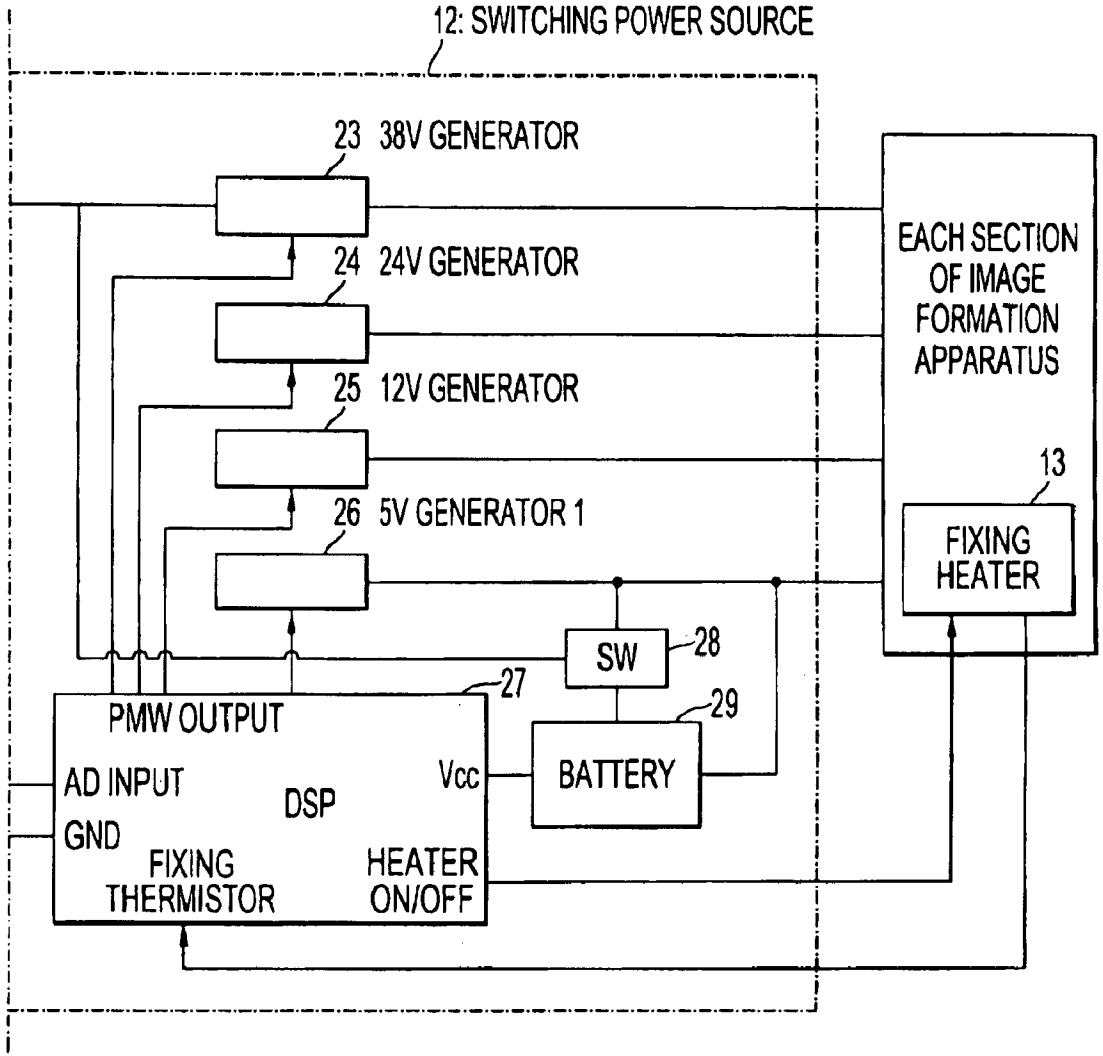

A structure of a power source that supplies power to the fixing heater disposed within the fixing roller 112 will be explained next with reference to FIGS. 3A and 3B. As shown in FIGS. 3A and 3B, in the image formation apparatus, an AC power source 11 supplies power to a switching power source 12 and a fixing heater 13. The fixing heater 13 is disposed in the fixing roller 112 of the fixing unit 111.

The switching power source 12 includes a filter 21, a rectification smoothing circuit 22 that rectifies and smoothes an AC voltage, DC voltage generators 23 to 26 that generate corresponding DC voltages respectively, a digital signal processor (DSP) 27 that controls the voltages generated by the DC voltage generators 23 to 26 respectively, a switch (SW) 28 that is turned on when the power from the AC power source 11 is applied to the switching power source 12 by turning on the main power switch, a battery 29 that supplies a necessary power source voltage to the DSP 27 when the switch 28 is turned on, and a power source waveform detecting circuit 30 that detects an AC power source waveform.

The DSP 27 has a function of a control unit that controls the generation of a DC voltage and controls a power supply to the fixing heater 13. More specifically, a detection result of a thermistor that measures the surrounding temperature of the fixing heater 13 is supplied to the DSP 27. The DSP 27 generates a signal for controlling the turning on/off of the fixing heater 13 so that the thermistor detection result reaches a predetermined value, that is, so that the temperature reaches a level at which the fixing unit 111 can operate normally. The DSP 27 outputs the signal to the fixing heater 13.

The control of turning on/off of the fixing heater 13 that the DSP 27 carries out, that is the control of turning on/off of the power supply to the fixing heater 13 will be explained in detail later. Although the DSP 27 is used as the control unit in the present embodiment, the control unit is not limited to the DSP 27. It is also possible to use other unit for the control unit so long as it has a similar function.

Figure 4:
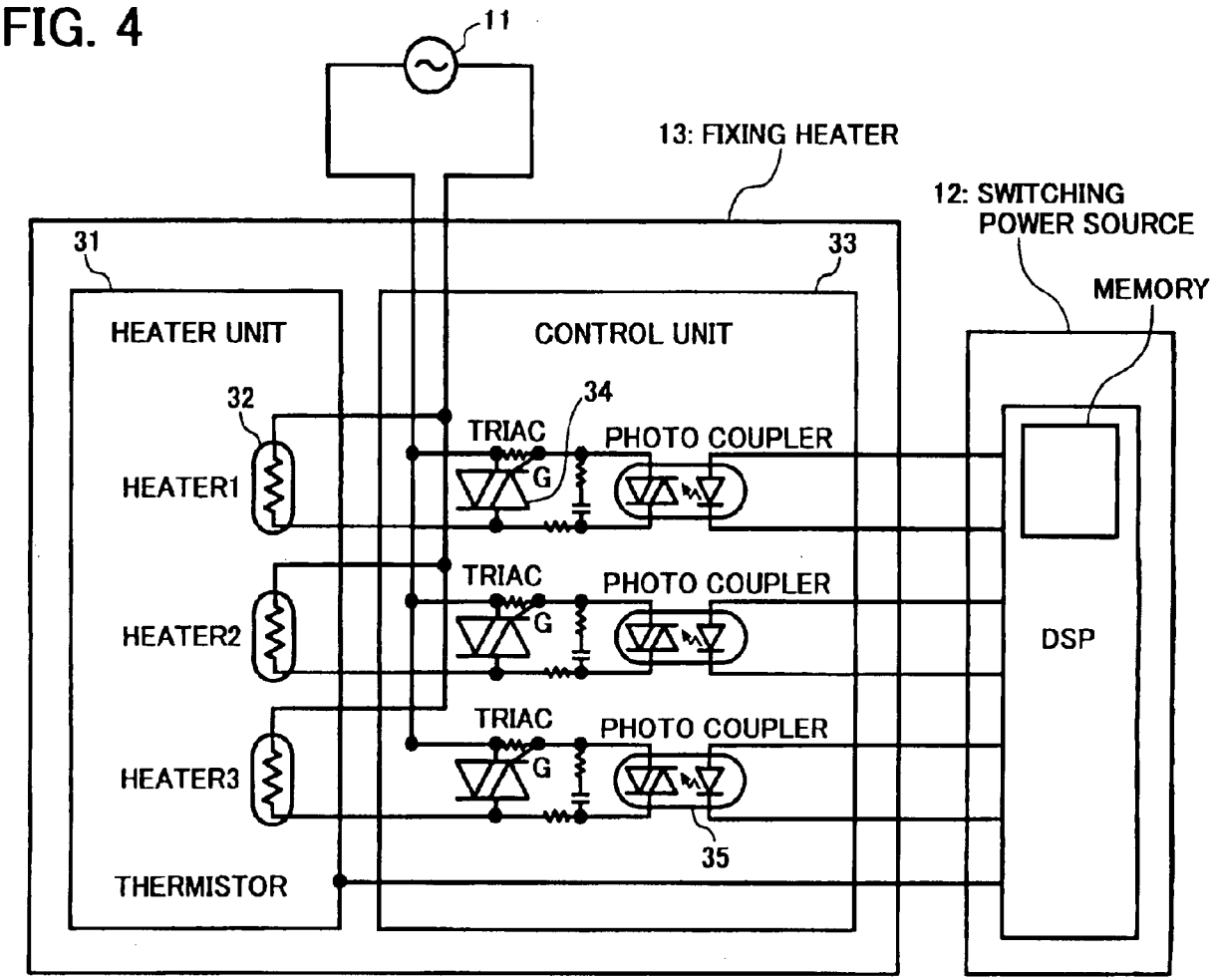
FIG. 4 is a schematic diagram of the fixing heater in the image formation apparatus.

FIG. 4 is a schematic diagram that illustrates a relation between the switching power source 12 and the fixing heater 13 of the image formation apparatus according to the present embodiment. As shown in FIG. 4, the fixing heater 13 has a heater unit 31, and a control unit 33. In the present embodiment, the heater unit 31 has three heaters 32, and the thermistor that detects a temperature of the fixing heater. A result of the detection by the thermistor is output to the DSP 27. The fixing roller, the pressure roller, a pressing mechanism, and an oil coating mechanism within the fixing unit 111 are not shown, and their detailed explanation will be omitted.

The control unit 33 has triacs 34 as circuits for turning on and off the heaters 32, and photo couplers 35. Based on this structure, when the DSP 27 of the switching power source 12 turns on one of the photo couplers 35, the corresponding triac 34 is turned on, and the power supply to a corresponding one of the heaters 32 is turned on.

The AC power source 11 supplies power to the switching power source 12 when the main power switch 7 of the image formation apparatus is turned on. The AC power from the AC power source 11 passes through the filter 21. The rectification smoothing circuit 22 carries out a full-wave rectification of the AC power, thereby to turn on the switch 28. When the switch 28 is turned on, the power accumulated in the battery 29 is supplied to the DSP 27, thereby to start the DSP 27.

The DSP 27 that is started in this way controls a 5V generator 26 based on a pulse wave modulation (PWM) control, thereby to generate a 5V voltage. The 5V voltage generated by the 5V generator 26 is recycled to the battery 29, thereby to replenish a driving voltage of the DSP 27. The 5V voltage is output to other than the switching power source 12, and is supplied to each unit of the image formation apparatus. As a result, each CPU within the image formation apparatus is started. The DSP 27 sequentially carries out a PWM control to the voltage generators 23 to 25 of other DC voltages (12V, 24V, and 38V), thereby to generate the DC voltages of 12V, 24V, and 38V respectively. The DSP 27 supplies these voltages to corresponding load units of the image formation apparatus.

The AC power source 11 supplies a power to the power source waveform detecting circuit 30 via the filter 21 when the main power switch 7 is turned on. The power source waveform detecting circuit 30 full-wave rectifies the AC power from the AC power source 11, and inputs the rectified power to the AD input of the DSP 27 via the transformer. In the present embodiment, the power source waveform detecting circuit 30 adjusts the input voltage to three one hundredth. In other words, the power source waveform detecting circuit 30 adjusts a voltage of 144V to 4.32V, and outputs this voltage to the AD input of the DSP 27.

Figure 5:
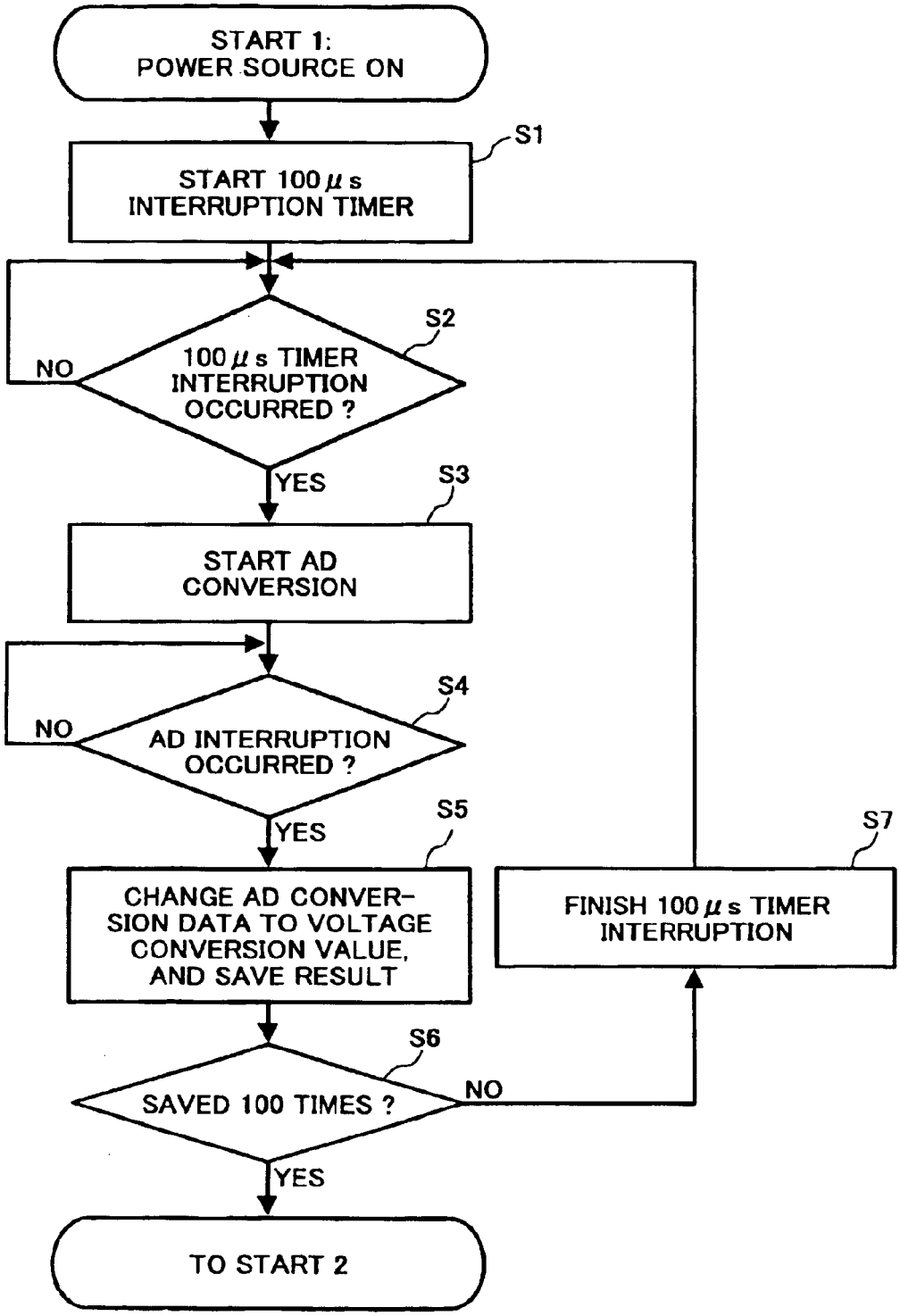

Next, the control of turning on/off of the power supply to the fixing heater 13 that the DSP 27 carries out will be explained with reference to FIG. 5. When the main power switch 7 is turned on to start the DSP 27, the DSP 27 starts a timer interruption at every predetermined period of time, for example, 100 μsec (step S1). The DSP 27 decides whether a timer interruption occurred (step S2). When a timer interruption is detected, the DSP 27 carries out an AD conversion based on the voltage supplied from the power source waveform detecting circuit 30 (step S3 and step S4), and obtains digital data corresponding to the voltage. In other words, the DSP 27 carries out the AD conversion at every 100 μsec, and obtains the power source voltage.

Figure 6:
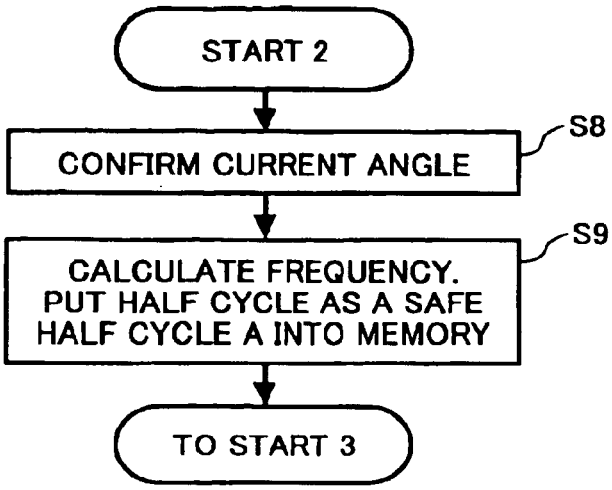

After the DSP 27 obtains digital data corresponding to the voltage, the DSP 27 stores the obtained voltage into an internal memory 141 (refer to FIG. 4) (step S5). The DSP 27 decides whether one hundred voltages are recorded (step S6). When one hundred voltages are not recorded, the DSP 27 finishes the interruption processing (step S7). Thereafter, at the next interruption-timing ("Yes" as a result of the decision made at step S2), the DSP 27 AD-converts the voltage supplied from the power source waveform detecting circuit 30, obtains digital data corresponding to the voltage, and records the voltage (steps S3 to S5). The DSP 27 carries out the voltage obtaining processing by one hundred times, thereby to obtain one hundred voltages, and records the voltages into the memory 41 ("Yes" as a result of the decision made at step S6). In other words, the DSP 27 obtains data corresponding to the voltage waveform during the period of 100 milliseconds (i.e., 100 μsec×100). Thereafter, the DSP 27 carries out a processing shown in FIG. 6. As explained above, in the present embodiment, the DSP 27 functions as a waveform-obtaining unit that obtains the voltage waveform of the AC power source 11 at the predetermined timing after the main power switch is turned on.

After the DSP 27 obtains the data corresponding to one hundred voltages, that is, the voltage waveform for the 10 millisecond period, the DSP 27 obtains a current angle from the last voltage, i.e., the hundredth voltage. In other words, the DSP 27 obtains an angle of the current voltage in one AC cycle (i.e., 360 degrees) (step S8).

The DSP 27 calculates a frequency of the power source voltage based on the obtained voltage waveform, calculates a half cycle A of the voltage waveform, and stores these values into the memory 41 (step S9). Then, the DSP 27 carries out a processing shown in FIG. 7.

Figure 7:
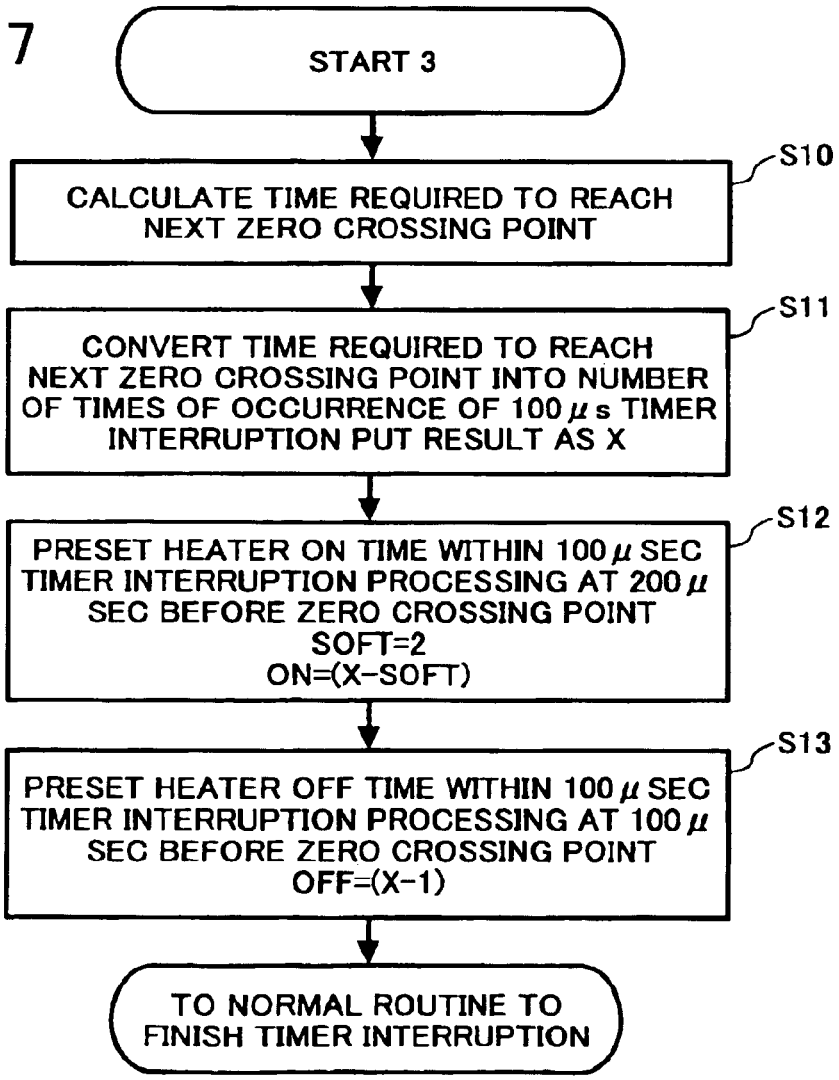

As shown in FIG. 7, the DSP 27 calculates a time required to reach a zero crossing point, from the current angle obtained above (step S10). For example, when the current angle is 90 degrees, it is possible to obtain the next zero crossing point at 180 degrees by multiplying the half cycle A by ½. As explained above, the DSP 27 obtains zero crossing information such as the time required to reach the next zero crossing point from the current point (i.e., information concerning the zero crossing point), and the zero crossing cycle (i.e., the half cycle A), based on the obtained voltage waveform.

In the present embodiment, a phase control is used as the control of power supply to the fixing heater 13. The first on-timing of power supply based on the phase control is set to a time of 200 μsec before the obtained zero crossing point.

After calculating the time required to reach the next zero crossing point, the DSP 27 converts the time required reaching the next zero crossing point into a number of times X of the occurrence of the interruption of the 100 μsec timer (step S11). For example, when the time required reaching the calculated zero crossing point is 1 millisecond, the number of times X of the occurrence of interruption is calculated as ten.

The DSP 27 obtains the first on-timing of supplying power to the fixing heater 13. In the present embodiment, the first on-timing is 200 μsec before the zero crossing point, as described above. The DSP 27 sets a variable for obtaining the on-timing as soft=2, and obtains the first on-timing as follows. In other words, the DSP 27 calculates how many times of the 100 μsec timer interruptions are carried out from the current time till (soft=2)×100=200 μsec reaches before the zero crossing point. When the number of times is calculated as ten from the zero crossing point as explained above, the DSP 27 calculates X(=10)−2=8 as the number of times of interruption till 200 μsec before the zero crossing point. The DSP 27 presets a time for turning on the power supply to the fixing heater 13 within the interruption processing at 200 μsec before the zero crossing point (step S12). In other words, the DSP 27 sets the number of times of interruption required until the timing obtained.

The DSP 27 also presets a time for turning off the power supply to the fixing heater 13 within the interruption processing at 100 μsec before the zero crossing point (step S13). In the present embodiment, the power supply is actually turned off at the zero crossing point. However, the turn-off-timing in software is set to 100 μsec before the zero crossing point.

Figure 11:
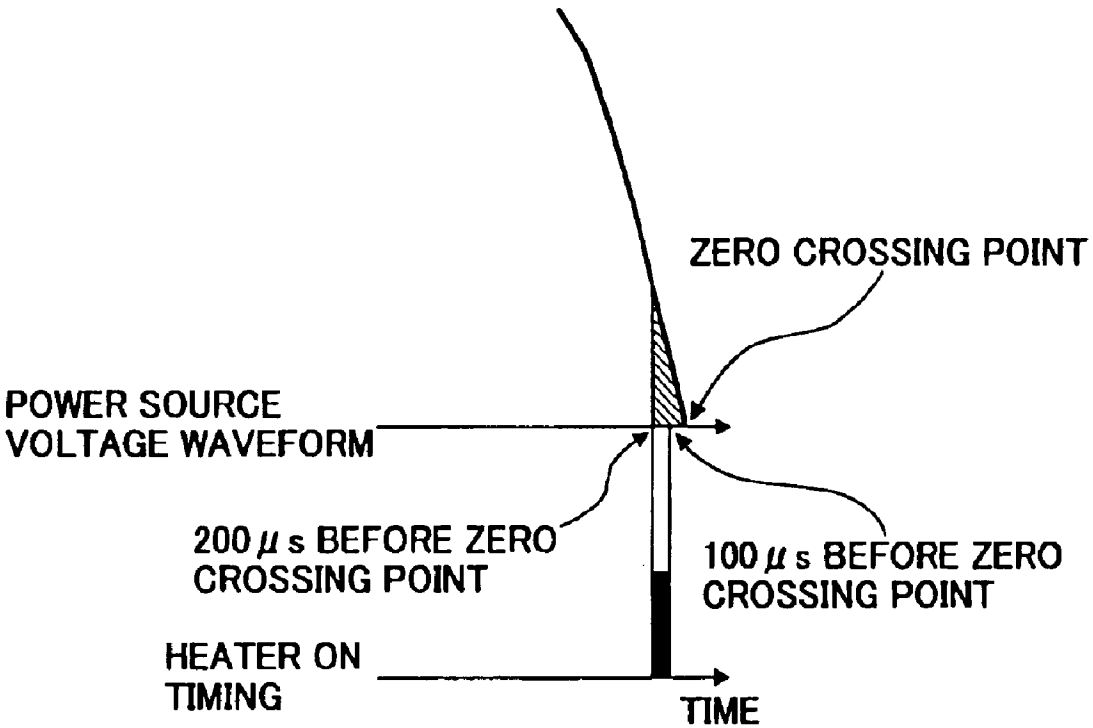
FIG. 11 illustrates on/off timings of the power supply based on the phase control operation.

Based on the above presetting, the first on-timing of the power supply to the fixing heater after the main power switch is turned on becomes the period between 200 μsec before the zero crossing point and 100 μsec before the zero crossing point as shown in FIG. 11.

Figure 8:
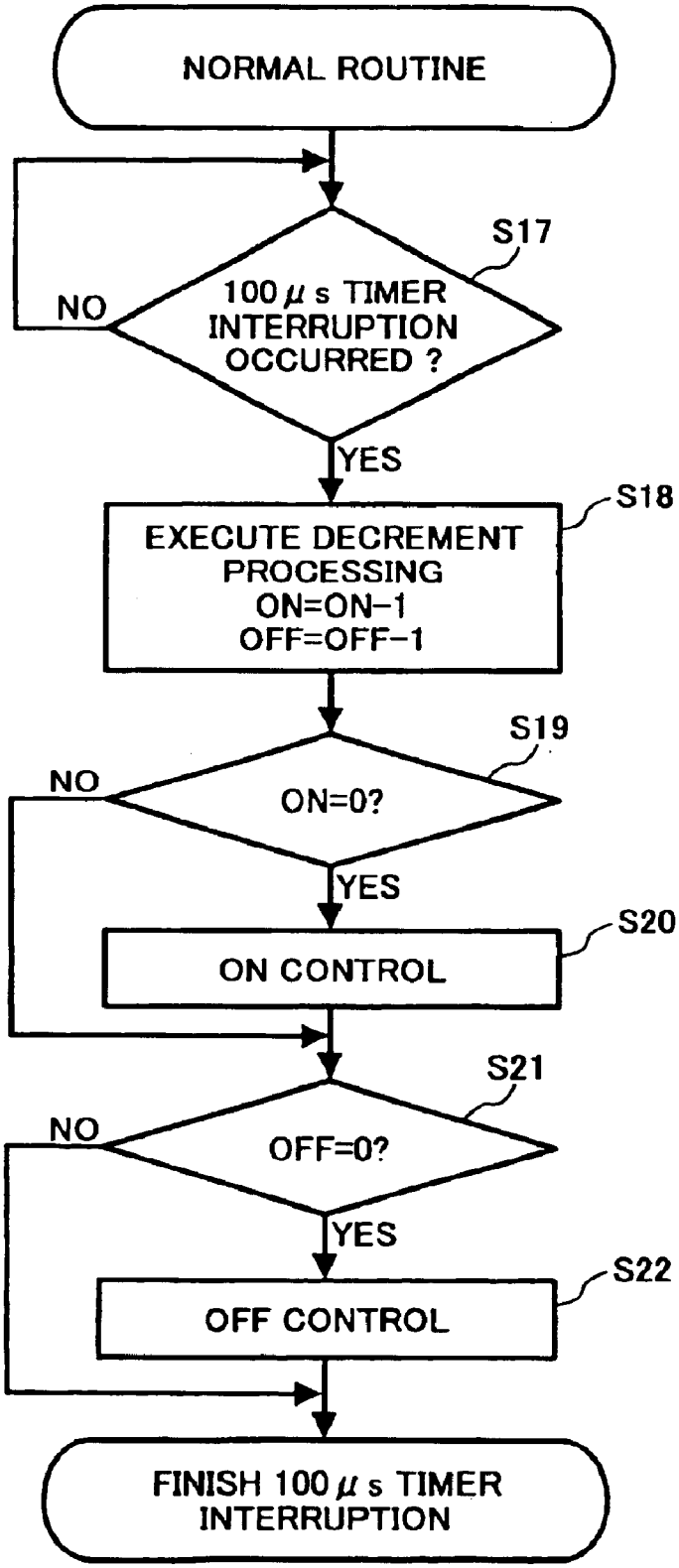
FIG. 8 is a flowchart illustrating an initial sequence of a phase control operation for a power supply that the image formation apparatus carries out.

After the main power switch is turned on, the DSP 27 presets the times through the above processing (refer to FIG. 5 to FIG. 7), and carries out a normal routine processing to supply power to the fixing heater 13 as explained below. In other words, as shown in FIG. 8, the DSP 27 decides whether the 100 μsec timer interruption occurred (step S17). At each time of the occurrence of the 100 μsec timer interruption, the DSP 27 carries out the following processing. First, the DSP 27 decreases the count value up to the preset heater-on-timing and the heater-off-timing (step S18).

The DSP 27 decides whether the count number of times of interruption up to the on-timing after the decrement becomes zero, that is, whether the preset on-timing of the power supply has reached (step S19).

Figure 9:
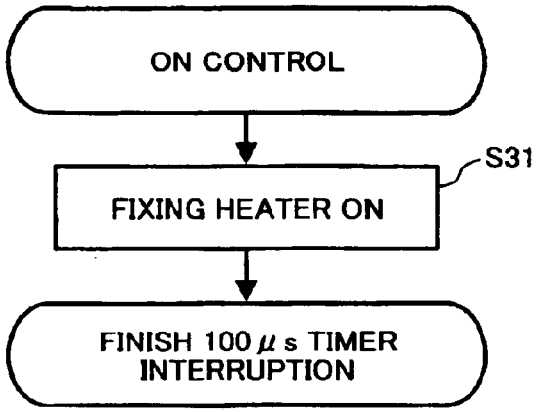
FIG. 9 is a flowchart illustrating a continuing sequence of the phase control operation for the power supply that the image formation apparatus carries out.

When the on-timing has reached (i.e., when 200 μsec before the zero crossing point has reached as the first on-timing since the main power switch is turned on), the DSP 27 controls the turning on of the power supply to the fixing heater 13 (step S20). As shown in FIG. 9, in the control of turning on the power supply, the DSP 27 generates an on-signal, and outputs the signal to the fixing heater 13, thereby to turn on the power supply to the fixing heater 13 (step S31). The DSP 27 finishes the 100 μsec timer interruption, and returns to step S17 shown in FIG. 8.

On the other hand, when the time is not the on-timing ("No" as a result of the decision made at step S19), the DSP 27 decides whether the count number of times of interruption up to the off-timing after the decrement becomes zero. In other words, the DSP 27 decides whether the time is 100 μsec before the zero crossing point as the preset off-timing (step S21).

When the off-timing has come, the DSP 27 carries out the control to turn off the power supply to the fixing heater 13, and the control to set the next on-timing and the next off-timing (step S22).

Figure 10:
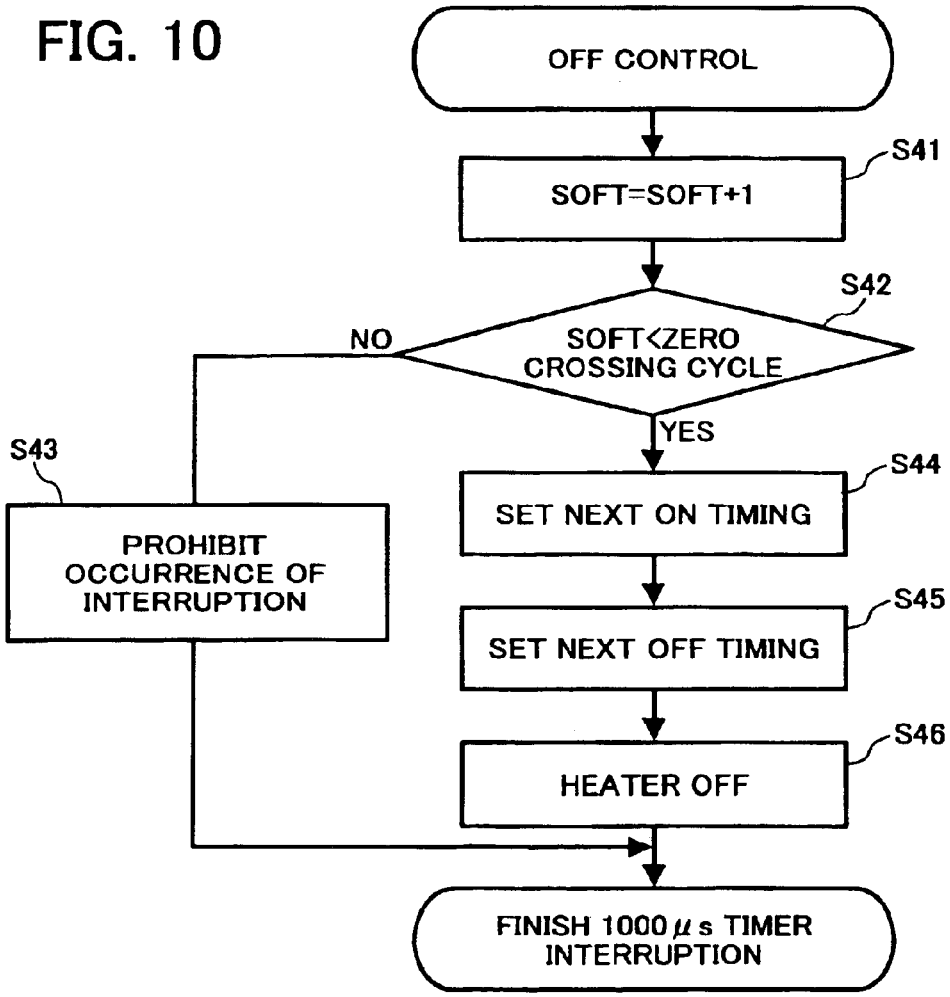
FIG. 10 is a flowchart illustrating a final sequence of the phase control operation for the power supply that the image formation apparatus carries out.

As shown in FIG. 10, the DSP 27 increases soft by one before turning off the power supply to the fixing heater 13 (step S41). The DSP 27 compares the value of the variable soft after the increment with number of times of 100 μsec timer interruption Y that occur during the half cycle A from the next zero crossing point till the zero crossing point after the next zero crossing point, and decides whether the variable soft is smaller than the number of interruption times Y (step S42).

As explained above, the value of the variable soft is used to determine the next on-timing of power supply based on the zero crossing point. This value shows that the power supply is to be turned on at the timing of soft×100 μsec before the zero crossing point. Therefore, when the variable soft is equal to or larger than the Y value, the on-timing to be determined based on the second next zero crossing point is the same timing as or earlier timing than the next zero crossing point. When the variable soft is smaller than the value Y, this means that the on-timing is later than the next zero crossing point.

Therefore, when the variable soft is larger than or equal to the value Y ("No" as a result of the decision made at step S42), the DSP 27 prohibits the 100 μsec timer interruption (step S43), and finishes the interruption processing. In other words, the DSP 27 does not execute the control to turn off the power supply to the fixing heater 13. The DSP 27 prohibits the timer interruption processing thereafter as well (i.e., the processing shown in FIG. 8 and FIG. 9). Therefore, the DSP 27 does not execute the control of turning off the power supply to the fixing heater 13, and maintains the on state of power supply.

On the other hand, when the value of the variable soft is smaller than the value Y ("Yes" as a result of the decision made at step S42), the DSP 27 sets a value obtained by subtracting the value of the soft from the number of times X(=Y+1) of the occurrence of timer interruption during the time required from the current time till the second next zero crossing point as a timer count value. The DSP 27 presets the turning on of the power supply to the fixing heater 13 at the timing when the timer count value becomes up (step S44).

After setting the next timing of turning on the power supply, the DSP 27 sets the next timing of turning off the power supply. Specifically, the DSP 27 sets the value obtained by subtracting one from the number of times X of the occurrence of timer interruption during the time required from the current time till the second next zero crossing point as a count value. The DSP 27 presets the turning off of the power supply to the fixing heater 13 at the timing when the timer count value becomes up (step S45).

As explained above, after setting the next timing of turning on and turning off the power supply, the DSP 27 generates a signal of turning off, and outputs the signal to the fixing heater 13, thereby to turn off the power supply to the fixing heater 13 (step S46). The DSP 27 finishes the 100 μsec timer interruption processing, and returns to the processing at step S17.

Figure 12:
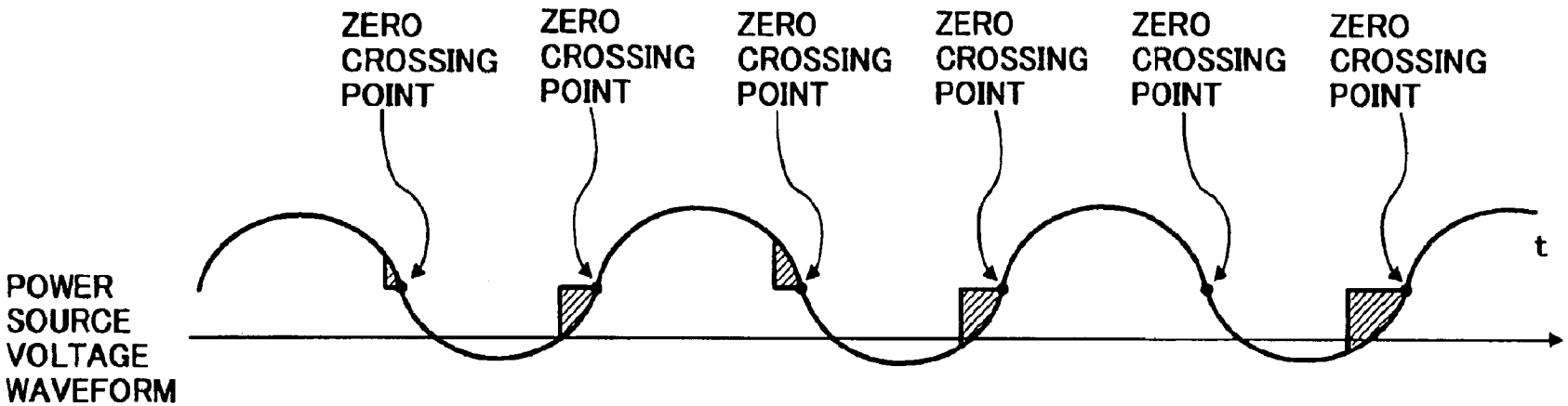
FIG. 12 illustrates a control of on/off-timing of the power supply based on the phase control operation.

As explained above, in the present embodiment, the DSP 27 advances the on-timing from the zero crossing point by each 100 μsec for each zero crossing cycle, as schematically shown in FIG. 12. In other words, the DSP 27 carries out the phase control of increasing the time for supplying power to the fixing heater 13 by 100 μsec. In FIG. 12, a shaded unit shows a period when the power supply is on. A state that the entire half cycle of the voltage waveform is on shows a full on-state.

Apart from the processing shown in FIG. 8 to FIG. 10, the DSP 27 carries out the control of power supply to the fixing heater 13 based on temperature information supplied from the thermistor of the fixing heater 13. When the AD-converted voltage of the thermistor that is an output value of the thermistor reaches a predetermined value, that is, when the fixing heater 13 reaches a predetermined temperature, the DSP 27 completely turns off the power supply.

On the other hand, when the DSP 27 detects a time when the temperature of the fixing heater 13 is excessively low, that is, when the DSP 27 detects that the AD-converted value of the thermistor becomes lower than a predetermined lower limit threshold value, the DSP 27 confirms an angle at this point of time (i.e., a phase angle of the voltage waveform). Then, the DSP 27 carries out a processing similar to the processings (at steps S10 to S13) shown in FIG. 7, and presets the heater-on-timing and off-timing based on the zero crossing point that arrives next. The DSP 27 permits the occurrence of the 100 μsec timer interruption, and carries out the processings after step S17 shown in FIG. 8. In other words, the DSP 27 carries out the phase control similar to that explained above, thereby to control the turning on/off of the power supply to the fixing heater 13, and set the heater 32 to the full on-state ("No" as a result of the decision made at step S42 in FIG. 10). It is possible to detect an angle at the point of time when the thermistor output value becomes lower than the threshold value, by detecting a variation in the voltage supplied from the power source waveform detecting circuit 30. For example, it is possible to detect the angle by obtaining voltages during at least two times of 100 μsec timer interruption processing. In the present embodiment, the fixing heater 13 has three heaters 32, and the DSP 27 carries out the phase control of the three heaters 32.

As explained above, in the present embodiment, the DSP 27 uses the zero crossing information such as the zero crossing point and the cycle derived based on the voltage waveform obtained during a constant period (10 milliseconds) after the main power switch is turned on, thereby to carry out the phase control of increasing the time for supplying power to the fixing heater 13 by 100 μsec.

Based on the above phase control, it is possible to execute turning on/off of the heater securely and precisely. The DSP 27 carries out the phase control by using the zero crossing information derived from the voltage waveform obtained during a constant period as described above. Therefore, even when the power supplied from the AC power source 11 includes a noise after a lapse of the period, or when the power source frequency is 50 Hz, 60 Hz, or 51 Hz, the DSP 27 can execute the phase control based on a more accurate zero crossing point without being influenced by the noise or the power source frequency. Consequently, even when the image formation apparatus is used in the environment that the commercial power source voltage includes a noise, it is possible to suppress control failures caused by an erroneous detection of a zero crossing timing.

In the present embodiment, the DSP 27 carries out the control by using the zero crossing information obtained after the main power switch is turned on at the predetermined timing as described above. Therefore, it is not necessary to provide a circuit that generates a zero crossing signal by always detecting a zero crossing timing from the voltage waveform. Consequently, it is possible to simplify the structure of the image formation apparatus. As it is not necessary to carry out the detection processing by always monitoring the voltage waveform, it is possible to decrease the processing load. In the present embodiment, the DSP 27 derives the zero crossing information at the timing before carrying out the phase control after the power source is turned on. Therefore, it is not necessary to carry out the phase control and the derivation processing at the same time. As a result, it is possible to lower the peak processing load.

Further, in the present embodiment, as the DSP 27 uses the obtained zero crossing information to control the power supply to the fixing heater 13, a dedicated circuit to generate the zero crossing signal is not necessary. In addition, it is not necessary to provide a structure for obtaining the zero crossing information and outputting the information to the DSP 27. Therefore, it is possible to simplify the structure of the image formation apparatus.

A first modification of the above embodiment will now be explained. In the above embodiment, the DSP 27 obtains a voltage waveform during a constant period after the main power switch is turned on, and derives the zero crossing signal based on the obtained voltage waveform. The DSP 27 executes a control based on the derived zero crossing signal. However, the DSP 27 can also derive the zero crossing signal as follows. At a predetermined timing after the main power switch 7 is turned on, the DSP 27 obtains voltage waveforms a plurality of times during a constant period (for example, ten milliseconds). The DSP 27 obtains the zero crossing information based on the obtained voltage waveforms.

For example, the DSP 27 obtains voltage waveforms by a preset number of times. In other words, the DSP 27 carries out the processing at steps S1 to S6 shown in FIG. 5 a preset number of times, and obtains a plurality of sets of data corresponding to the voltage waveforms during the ten milliseconds. In the mean time, the user inputs in advance the power source frequency information about whether the power source that supplies power to the image formation apparatus is 50 Hz or 60 Hz.

The DSP 27 extracts one or a plurality of voltage waveforms from among the obtained voltage waveforms, based on a standard of a frequency close to the input power source frequency information. The DSP 27 obtains zero crossing information such as the half cycle A and the zero crossing point based on the extracted voltage waveforms. When a plurality of voltage waveforms is extracted, the DSP 27 selects a majority of voltage waveforms having the same frequency.

Based on the above arrangement, it is possible to extract voltage waveforms having little influence of a noise from among the voltage waveforms obtained a plurality of times. It is possible to use these extracted voltage waveforms to derive zero crossing information. Based on this, it is possible to obtain more accurate zero crossing information.

The DSP 27 obtains a plurality of voltage waveforms as explained in the first modification. When the frequencies of all of these obtained voltage waveforms are identical, or when the frequencies of at least a predetermined number of voltage waveforms are identical, the DSP 27 may derive zero crossing information based on the voltage waveform from which the identical frequency is obtained. For example, it is possible to set a standard that, when the DSP 27 obtains a voltage waveform five times, the frequencies of all the five voltage waveforms must be identical or a standard that, when the DSP 27 obtains voltage waveforms at a relatively large number of times, for example, ten times, the frequencies of nine voltage waveforms out of the ten voltage waveforms must be identical. With this arrangement, it is possible to eliminate voltage waveforms that have the noise. Therefore, it is possible to derive zero crossing information more accurately.

Figure 13:
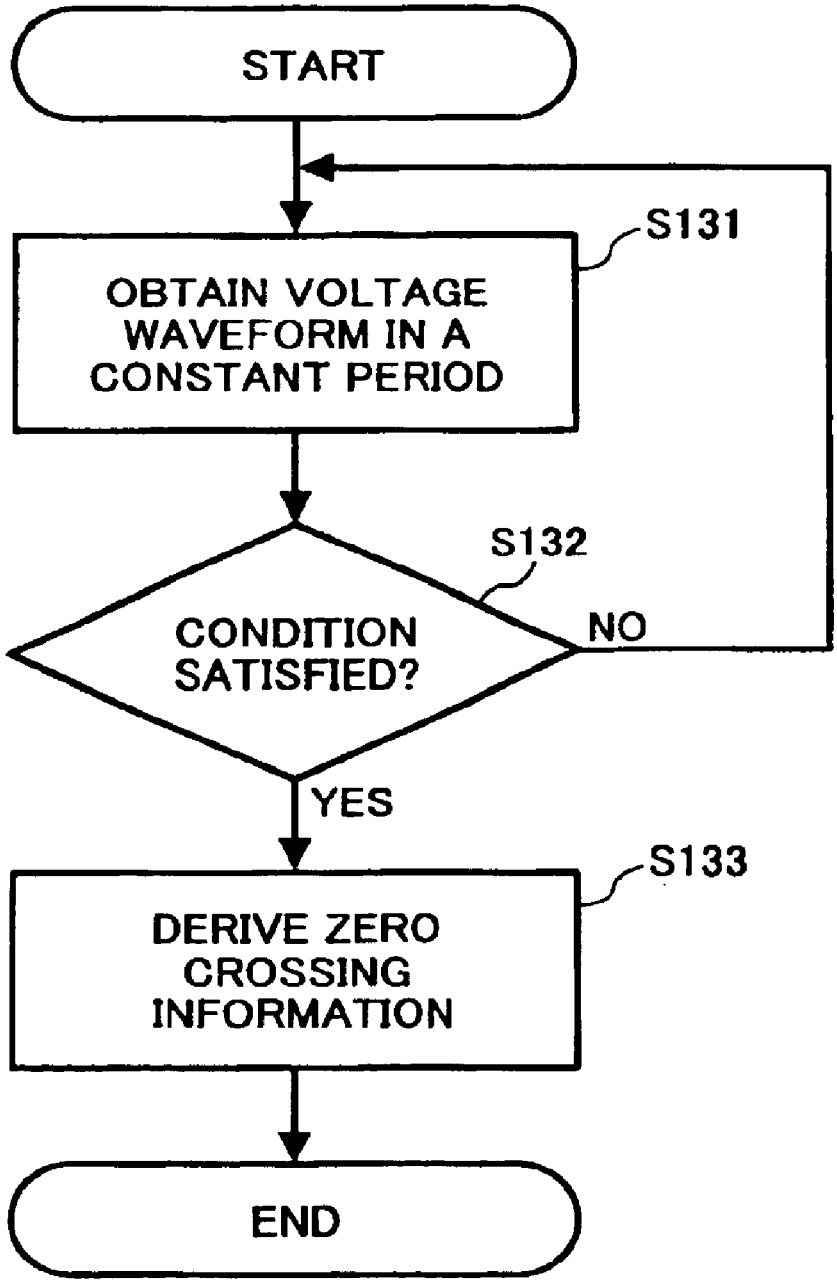
FIG. 13 is a flowchart illustrating a sequence of a zero crossing information deriving process used for a phase control that is carried out in a modification of the image formation apparatus.
Figure 14:
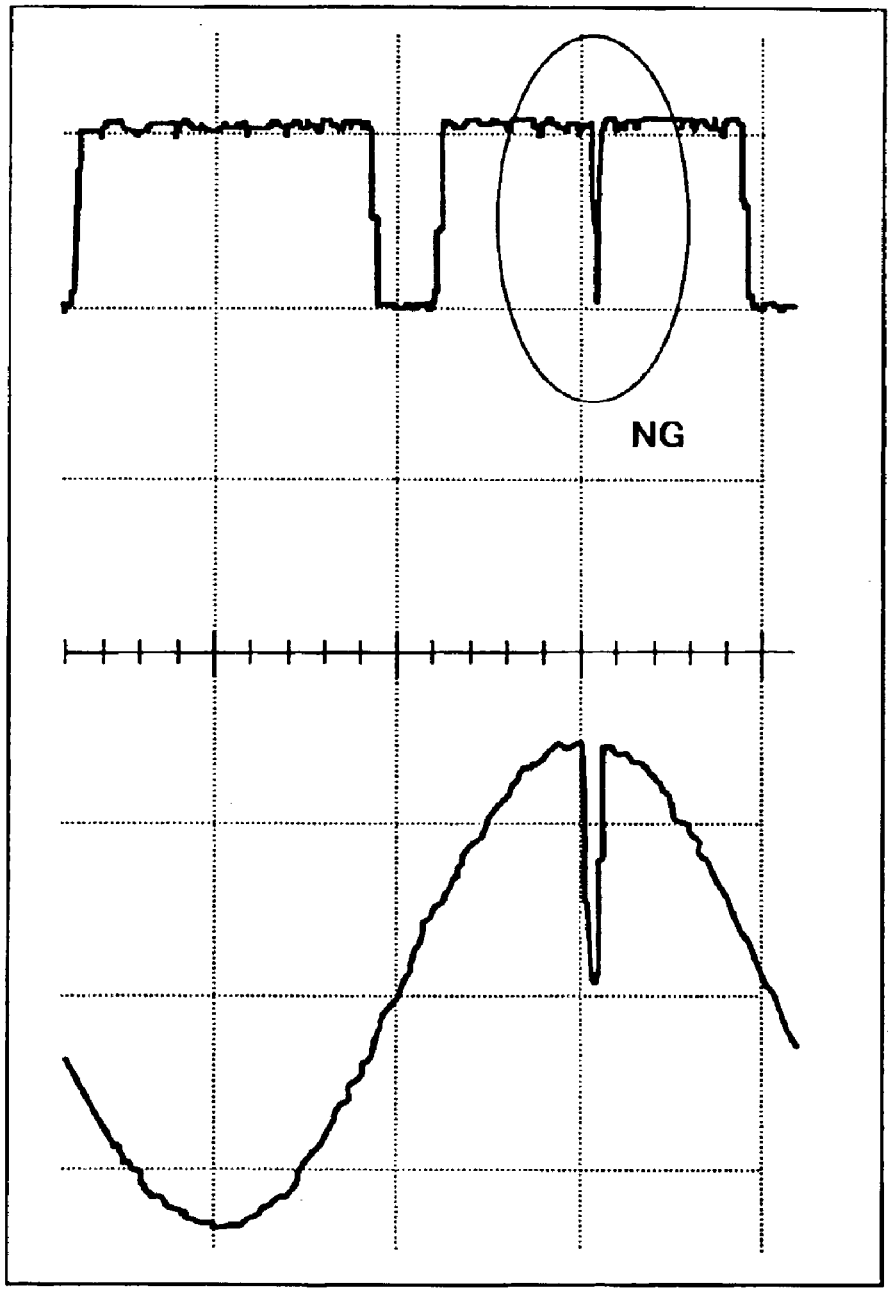
FIG. 14 is a graph displaying an erroneous detection of a zero crossing signal.

A second modification of the above embodiment will now be explained. As shown in FIG. 13, the DSP 27 obtains voltage waveforms during a constant period (for example, ten milliseconds) (step S131), and decides whether the obtained voltage waveforms satisfy a predetermined condition (step S132). When the obtained voltage waveforms satisfy the predetermined condition, the DSP 27 may derive zero crossing information as explained in the above embodiment based on the obtained voltage waveforms (step S133).

On the other hand, when the obtained voltage waveforms do not satisfy the predetermined condition, the DSP 27 returns to step S131, and obtains voltage waveforms during the constant period again, and decides whether the obtained voltage waveforms satisfy the predetermined condition (step S132). When the obtained voltage waveforms satisfy the predetermined condition, the DSP 27 may derive zero crossing information based on the obtained voltage waveforms. When the voltage waveforms do not satisfy the predetermined condition even after the DSP 27 obtains the voltage waveforms by a predetermined number of times, the DSP 27 may discontinue the processing by making a display of this fact on the display panel of the operating unit 3.

As the predetermined condition, it is possible to set the frequencies of the obtained voltage waveforms to within a range from 45 Hz to 64 Hz, as the general commercial power source has the frequency of 50 Hz or 60 Hz. It is also possible to set a condition that, when the user inputs the power source frequency information as 50 Hz, the frequencies of the obtained voltage waveforms are within a range of the input frequency 50 Hz±4 Hz. With this arrangement, it is possible to reduce the risk of deriving erroneous zero crossing information caused by a clearly abnormal voltage waveform due to a noise or the like. Therefore, it is possible to derive zero crossing information more accurately.

In the case that the DSP 27 extracts voltage waveforms that satisfies the condition that the frequencies of all voltage waveforms are identical or the frequencies of a majority of voltage waveforms obtained are identical, when the obtained voltage waveforms do not satisfy the above condition, the DSP 27 can obtain a plurality of voltage waveforms again, and decide whether the frequencies of all the voltage waveforms or a majority of the voltage waveforms are identical. When the frequencies are identical, the DSP 27 obtains zero crossing information by using the voltage waveforms of which the identical frequencies are obtained.

A third modification of the above embodiment will now be explained. When the voltage waveform that the DSP 27 obtains includes a noise, the DSP 27 may identify the noise portion, and derive zero crossing information based on the obtained voltage waveform from which the identified noise portion is excluded.

For example, the DSP 27 refers to data corresponding to one hundred voltages that are obtained, and when a voltage variation per unit time shown in the data is higher than a threshold value, the DSP 27 identifies this portion as a noise. In other words, when a voltage variation actually obtained per unit time is clearly larger than a voltage variation per unit time (i.e., 100 $\mu$sec in this example) when the voltage variation is normal without a noise, the DSP 27 identifies the portion as a noise. The normal voltage variation of the AC power source per unit time is different depending on the phase angle. Therefore, the threshold value may be set for each phase angle. The DSP 27 compares an actually measured value at each phase angle with a corresponding threshold value.

With the above arrangement, even when the obtained voltage waveform includes a noise, it is possible to derive zero crossing information by using a portion from which the noise is excluded. As a result, it is possible to suppress an erroneous detection of zero crossing information caused by the noise included in the voltage waveform.

It is also possible to arrange such that the DSP 27 obtains a plurality of voltage waveforms as explained in the first modification, removes a noise from each voltage waveform, and obtains zero crossing information based on the voltage waveforms after removal of the noise. For example, when the frequencies of all the obtained voltage waveforms or the a majority of the voltage waveforms after removing the noise are identical, the DSP 27 may derive zero crossing information by using the voltage waveforms of which frequencies are identical.

A fourth modification of the above embodiment will now be explained. The DSP 27 may compare power source voltage waveform data of a plurality of frequencies that are stored in the memory with an obtained voltage waveform, thereby to select voltage waveform data that are closest to the obtained voltage waveform. The DSP 27 may use the selected voltage waveform data to derive zero crossing information. In other words, the DSP 27 obtains a zero crossing cycle (corresponding to a half cycle of the voltage waveform) based on the frequency of the selected voltage waveform data. It is also possible to derive a zero crossing cycle and a zero crossing point as follows. A region in which the obtained voltage is within a predetermined range is set as a zero crossing region. The DSP 27 derives a zero crossing cycle and a zero crossing point by referring to consecutive voltages from the regions.

A fifth modification of the above embodiment will now be explained. Further, to derive zero crossing information, the DSP 27 may use information (for example, information of a frequency) concerning a voltage waveform that is used at the previous timing of deriving zero crossing information. More specifically, at a predetermined timing when the main power source is turned on, the DSP 27 obtains a voltage waveform thereby to obtain zero crossing information in a similar manner to that of the above embodiment and modifications. Then, the DSP 27 obtains information concerning the voltage waveform that is used to derive the zero crossing information, and stores this information into the nonvolatile memory (i.e., the most-recent-information memory) 41. When the memory 41 stores information concerning a voltage waveform used to derive zero crossing information before the previous time, the voltage information will be overwritten into the memory 41.

At the next timing of deriving zero crossing information (i.e., when the main power source is turned on next), the DSP 27 may derive the zero crossing information based on the information concerning the voltage waveform stored in the memory 41 and the voltage waveform obtained at the corresponding timing.

For example, when the frequency of the obtained voltage waveform is identical with the frequency of the previous voltage waveform, the DSP 27 derives the zero crossing information based on the obtained voltage waveform. On the other hand, when the frequency of the obtained voltage waveform is not identical with the frequency of the previous voltage waveform, the DSP 27 obtains a voltage waveform again. As explained above, when the voltage waveform of which frequency is identical with the frequency of the previous voltage waveform is obtained, the DSP 27 may derive the zero crossing information by using the voltage waveform obtained.

As explained above, the DSP 27 compares the information concerning the voltage waveform that is used to derive the previous zero crossing information with the voltage waveform that is obtained to derive the present zero crossing information. Based on this comparison, it is possible to decide whether the present voltage waveform obtained is normal.

When the DSP 27 obtains a plurality of voltage waveforms as explained in the first modification, the DSP 27 may select a voltage waveform to be used to derive the zero crossing information as follows. Namely, when the frequencies of all the obtained voltage waveforms or a majority of the obtained voltage waveforms are identical with the frequency of the previous voltage waveform, the DSP 27 may extract the voltage waveform of which the frequency is identical from among the obtained voltage waveforms. The DSP 27 derives zero crossing information by using the voltage waveform extracted. In this case since the DSP 27 refers to the information concerning the previous voltage waveform when deciding whether the obtained voltage waveform is normal, it is possible to maintain accuracy of the decision even with decreased number of voltage waveforms that are to be obtained, thereby It is possible to reduce a processing load.

A sixth modification of the above embodiment will now be explained. In the above embodiment and modifications, after the main power switch is turned on, the DSP 27 obtains one or a plurality of voltage waveforms during a constant period, and derives zero crossing information based on the obtained voltage waveforms. The timing when the DSP 27 obtains the voltage waveforms to derive the zero crossing information is not limited to a time after the main power switch 7 is turned on. The DSP 27 can also obtain a voltage waveform periodically, for example, at every one hour, thereby to obtain zero crossing information. Thereafter, the DSP 27 may use zero crossing information obtained at the moment, in place of the zero crossing information previously obtained, thereby to carry out the phase control.

At a timing before starting the control determined to be performed, that is, at a timing before carrying out the phase control to supply power to the fixing heater 13 in the embodiment of the present invention, the DSP 27 may obtain voltage waveforms, thereby to derive zero crossing information, and carry out the phase control by using the derived zero crossing information, in a similar manner to that of the above embodiment and modifications.

In a general image formation apparatus, the DSP 27 carries out the phase control to supply power to the fixing heater 13. This control is carried out in order to suppress an inrush current from becoming large when the temperature of the fixing heater is low. When the image formation apparatus is executing a copying operation, the temperature of the fixing heater is high, and, therefore, it is not necessary to carry out the phase control. In other words, in the image formation apparatus, the phase control is not always carried out at the time of driving the fixing heater. Instead, it is general that the phase control is carried out at the interval of about 30 seconds to one minute in a waiting mode. Even when the phase control is carried out, the actual period for executing the phase control is about one second. Usually, the phase control is carried out for only one second per each time interval of 30 seconds to one hour.

Therefore, as explained in the present modification, at a timing before carrying out a phase control, the DSP 27 obtains voltage waveforms to obtain zero crossing information that is used to carry out the phase control. Based on this processing, it is not necessary to always operate the timer (i.e., the timer that counts a zero crossing cycle) to understand the zero crossing point while the phase control is not carried out (i.e., most of the time). Consequently, it is possible to decrease the processing load. As the phase control is not carried out during the copying operation, it is possible to use the timer for other purpose during the copying operation. As a result, it is possible to effectively use the system resources.

A seventh modification of the above embodiment will now be explained. In the above embodiment, it is explained that the present invention is applied to the image formation apparatus that obtains voltage waveforms supplied from the AC power source 11, thereby to obtain zero crossing information, and supplies power to the fixing heater 13 by using the zero crossing information. However, it is also possible to use the zero crossing information derived in the image formation apparatus for other types of controls. In an electric appliance other than the image formation apparatus to which a power is supplied from the AC power source 11, a controller (such as a DSP or a CPU) mounted on the electric appliance may obtain a voltage waveform of the AC power source 11. The controller obtains zero crossing information such as a zero crossing point and a cycle based on the obtained voltage waveform. The controller then controls power supply to the load circuit in the electric appliance, by using the obtained zero crossing information.

It is of course possible to arrange as follows. Like the DSP 27, the controller that obtains a voltage waveform thereby to obtain zero crossing information, and controls power supply by using the obtained zero crossing information is distributed in a state that the controller is mounted on a device such as an information deriving apparatus. Instead, it is also possible to market only a device that detects zero crossing information based on a method of deriving zero crossing information in a similar manner to that explained above, thereby to provide the device to users and manufacturers.

An eighth modification of the above embodiment will now be explained. In the above embodiment and modifications, it is explained that the DSP 27 executes the processing of obtaining voltage waveforms thereby to obtain zero crossing information (refer to FIG. 5 to FIG. 10). Instead, it is also possible to provide users and manufactures with a program that makes a computer execute the processing, via communication means such as the Internet, a telephone network, and a radio communication network. It is also possible to provide the users and manufactures with the program by recording the program onto a computer-readable recording medium such as a CD-ROM (Compact Disc Read-Only Memory).

As explained above, according to a first aspect of the present invention, it is not necessary to always monitor a voltage variation in an AC power source in order to obtain a zero crossing information. Therefore, it is possible to reduce a processing load, and it is possible to reduce an erroneous detection of the zero crossing point when a noise occurs in the AC power source after obtaining the zero crossing information.

According to a second aspect of the present invention, even when the obtained voltage waveform includes a noise, it is possible to reduce a deriving of erroneous zero crossing information caused by the noise.

According to a third aspect of the present invention, even when the obtained voltage waveform includes a noise, it is possible to suppress an extraction of such voltage waveform, thereby it is possible to reduce a deriving of erroneous zero crossing information caused by the noise.

According to a fourth aspect of the present invention, even when obtained voltage waveform includes a noise, it is possible to suppress an extraction of the voltage waveform including the noise; thereby it is possible to reduce a deriving of erroneous zero crossing information.

According to a fifth aspect of the present invention, when a commercial power source frequency is known, the information on the power source frequency can be used as an input condition. Based on the input condition, it is possible to reduce a voltage waveform different from the input condition altogether being used for deriving the zero crossing information; thereby it is possible to reduce a deriving of erroneous zero crossing information.

According to a sixth aspect of the present invention, when a voltage waveform includes a noise and is not suitable to derive the zero crossing information, the voltage waveform is not considered to satisfy a condition, thereby it is possible to reduce a deriving of zero crossing information based on the noisy voltage waveform, and it is possible to reduce a deriving of erroneous zero crossing information.

According to a seventh aspect of the present invention, even when obtained voltage waveform includes a noise, there is an effect that it is possible to decrease a deriving of erroneous zero crossing information caused by the noise.

According to an eighth aspect of the present invention, even when obtained voltage waveform includes a noise, it is possible to reduce a deriving of erroneous zero crossing information caused by the noise.

According to a ninth aspect of the present invention, it is possible to reduce a deriving of erroneous zero crossing information.

According to a tenth aspect of the present invention, it is possible to simplify a structure and a processing.

According to an eleventh aspect of the present invention, it is not necessary to always monitor a voltage variation in an AC power source in order to obtain a zero crossing information. Therefore, it is possible to reduce a processing load, and it is possible to reduce an erroneous detection of the zero crossing point when a noise occurs in the AC power source after obtaining the zero crossing information.

According to a twelfth aspect of the present invention, it is not necessary to always monitor a voltage variation in an AC power source in order to obtain a zero crossing information. Therefore, it is possible to reduce a processing load, and it is possible to reduce an erroneous detection of the zero crossing point when a noise occurs in the AC power source after obtaining the zero crossing information.

According to a thirteenth aspect of the present invention, even when the obtained voltage waveform includes a noise, it is possible to reduce a deriving of erroneous zero crossing information caused by the noise.

According to a fourteenth aspect of the present invention, even when the obtained voltage waveform includes a noise, it is possible to suppress an extraction of such voltage waveform, thereby it is possible to reduce a deriving of erroneous zero crossing information caused by the noise.

According to a fifteenth aspect of the present invention, even when obtained voltage waveform includes a noise, it is possible to suppress an extraction of the voltage waveform including the noise; thereby it is possible to reduce a deriving of erroneous zero crossing information.

According to a sixteenth aspect of the present invention, when a commercial power source frequency is known, the information on the power source frequency can be used as an input condition. Based on the input condition, it is possible to reduce a voltage waveform different from the input condition altogether being used for deriving the zero crossing information; thereby it is possible to reduce a deriving of erroneous zero crossing information.

According to a seventeenth aspect of the present invention, when a voltage waveform includes a noise and is not suitable to derive the zero crossing information, the voltage waveform is not considered to satisfy a condition; thereby it is possible to reduce a deriving of zero crossing information based on the noisy voltage waveform, and it is possible to reduce a deriving of erroneous zero crossing information.

According to an eighteenth aspect of the present invention, even when obtained voltage waveform includes a noise, there is an effect that it is possible to decrease a deriving of erroneous zero crossing information caused by the noise.

According to a nineteenth aspect of the present invention, even when obtained voltage waveform includes a noise, it is possible to reduce a deriving of erroneous zero crossing information caused by the noise.

According to a twentieth aspect of the present invention, it is possible to reduce a deriving of erroneous zero crossing information.

According to a twenty-first aspect of the present invention, during a period while the control using zero crossing information is not carried out, zero crossing information derived previously is used for the next control using zero crossing information, thereby it is not necessary to carry out a timer counting and the like, and it is possible to simplify a structure and a processing.

According to a twenty-second aspect of the present invention, it is not necessary to always monitor a voltage variation in an AC power source in order to obtain a zero crossing information. Therefore, it is possible to reduce a processing load, and it is possible to reduce an erroneous detection of the zero crossing point when a noise occurs in the AC power source after obtaining the zero crossing information.

According to a twenty-third aspect of the present invention, the turning on/off of power supply to the fixing unit is controlled by using the zero crossing information derived as explained above; thereby it is possible to carry out a more secure and precise control.

According to a twenty-fourth aspect of the present invention, the turning on/off of power supply to the fixing unit is controlled based on a phase control using the zero crossing information derived as explained above, thereby it is possible to carry out a more secure and precise control.

According to a twenty-fifth aspect of the present invention, it is not necessary to always monitor a voltage variation in an AC power source in order to obtain a zero crossing information. Therefore, it is possible to reduce a processing load, and it is possible to reduce an erroneous detection of the zero crossing point when a noise occurs in the AC power source after obtaining the zero crossing information.

According to a twenty-sixth aspect of the present invention, it is possible to make a computer function as a device that has a structure similar to an apparatus according to claim 1 of the present invention; thereby it is possible to reduce a processing load, and it is possible to reduce an erroneous detection of the zero crossing point when a noise occurs in the AC power source after obtaining the zero crossing information.

The present document incorporates by reference the entire contents of Japanese priority documents, 2002-179119 filed in Japan on Jun. 19, 2002 and 2003-122747 filed in Japan on Apr. 25, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An information deriving apparatus comprising:

a waveform obtaining unit that obtains a voltage waveform of an AC power source during a predetermined period following activation of the AC power source and not obtaining the voltage waveform after the predetermined period; and a deriving unit that derives zero crossing information based on the voltage waveform obtained.

2. The information deriving apparatus according to claim 1, wherein the waveform obtaining unit obtains the voltage waveform a plurality of times during the predetermined period.

3. The information deriving apparatus according to claim 2, wherein the deriving unit extracts a voltage waveform based on a predetermined standard from among the voltage waveforms obtained, and derives zero crossing information based on the extracted voltage waveform.

4. The information deriving apparatus according to claim 3, wherein the deriving unit extracts a plurality of voltage waveforms, and if frequencies of all or more than a predetermined number of extracted voltage waveforms are identical, the deriving unit derives zero crossing information based on a voltage waveform from which the identical frequency is obtained.

5. The information deriving apparatus according to claim 3, wherein the deriving unit extracts a voltage waveform close to an input condition from among the voltage waveforms obtained, and derives zero crossing information based on the extracted voltage waveform.

6. The information deriving apparatus according to claim 1, wherein the waveform obtaining unit detects whether the voltage waveform obtained satisfies a predetermined condition, wherein the waveform obtaining unit obtains a new voltage waveform of the AC power source if the obtained voltage waveform does not satisfies the predetermined condition, and the deriving unit derives zero crossing information based on the new voltage waveform obtained.

7. The information deriving apparatus according to claim 1, wherein the deriving unit identifies a portion of the obtained voltage waveform that contains a noise, and derives zero crossing information based on a portion other than the portion that contains the noise.

8. The information deriving apparatus according to claim 1, wherein the deriving unit compares the obtained voltage waveform with data of a plurality of voltage waveforms prepared in advance, selects voltage waveform data closest to the voltage waveform obtained, and derives zero crossing information based on the selected voltage waveform data.

9. The information deriving apparatus according to claim 1, further comprising a most-recent-information storing unit that stores information about a voltage waveform used to derive zero crossing information by the deriving unit, wherein the deriving unit derives, during the predetermined period, zero crossing information based on the obtained voltage waveform and the information about the voltage waveform stored in the most-recent-information storing unit.

10. The information deriving apparatus according to claim 1, further comprising a control unit that carries out a predetermined control based on the zero crossing information, wherein the predetermined period is a period before the control unit carries out the control.

11. An electric appliance comprising:

a load unit;

an AC power source that supplies power to the load unit;

a waveform obtaining unit that obtains a voltage waveform of the AC power source during a predetermined period following activation of the AC power source and not obtaining the voltage waveform after the predetermined period;

a deriving unit that derives zero crossing information based on the voltage waveform obtained; and a control unit that controls the power supply from the AC power source to the load unit based on the zero crossing information.

12. An image formation apparatus comprising:

a load unit;

an AC power source that supplies power to the load unit;

an image transfer unit that transfers an image to a recording medium;

a fixing unit that heats and fixes the image transferred by the image transfer unit;

a waveform obtaining unit that obtains a voltage waveform of the AC power source during a predetermined period following activation of the AC power source and not obtaining the voltage waveform after the predetermined period;

a deriving unit that derives zero crossing information based on the voltage waveform obtained; and a control unit that controls the power supply from the AC power source to the load unit based on the zero crossing information.

13. The image formation apparatus according to claim 12, wherein the waveform obtaining unit obtains the voltage waveform of the AC power source a plurality of times during the predetermined period.

14. The image formation apparatus according to claim 13, wherein the deriving unit extracts a voltage waveform based on a predetermined standard from among the voltage waveforms obtained, and derives zero crossing information based on the extracted voltage waveform.

15. The image formation apparatus according to claim 14, wherein the deriving unit extracts a plurality of voltage waveforms, and if frequencies of all or more than a predetermined number of extracted voltage waveforms are identical, the deriving unit derives zero crossing information based on a voltage waveform from which the identical frequency is obtained.

16. The image formation apparatus according to claim 14, wherein the deriving unit extracts a voltage waveform close to an input condition from among the voltage waveforms obtained, and derives zero crossing information based on the extracted voltage waveform.

17. The image formation apparatus according to claim 12, wherein the waveform obtaining unit detects whether the obtained voltage waveform satisfies a predetermined condition, wherein the waveform obtaining unit obtains a new voltage waveform of the AC power source if the obtained voltage waveform does not satisfy the predetermined condition, and the deriving unit derives zero crossing information based on the new voltage waveform obtained.

18. The image formation apparatus according to claim 12, wherein the deriving unit identifies a portion of the obtained voltage waveform that contains a noise, and derives zero crossing information based on a portion other than the portion that contains the noise.

19. The image formation apparatus according to claim 12, wherein the deriving unit compares the obtained voltage waveform with data of a plurality of voltage waveforms prepared in advance, selects voltage waveform data closest to the obtained voltage waveform, and derives zero crossing information based on the selected voltage waveform data.

20. The image formation apparatus according to claim 12, further comprising a most-recent-information storing unit that stores information about a voltage waveform used to derive zero crossing information by the deriving unit, wherein the deriving unit derives, during the predetermined period, zero crossing information based on the obtained voltage waveform and the information about the voltage waveform stored in the most-recent-information storing unit.

21. The image formation apparatus according to claim 12, wherein the predetermined period is a period before the control unit controls the power supply from the AC power source to the fixing unit based on the zero crossing information.

22. An image formation apparatus comprising:

an image transfer unit that transfers an image to a recording medium;

a fixing unit that receives a power from an AC power source, and heats and fixes the image transferred by the image transfer unit; and a switching power source that rectifies an AC voltage from the AC power source to generate a plurality of DC voltages, wherein the switching power source includes a waveform obtaining unit that obtains a voltage waveform of an AC power source during a predetermined period following activation of the AC power source and not obtaining the voltage waveform after the predetermined period;

a deriving unit that derives zero crossing information based on the voltage waveform obtained; and a control unit that controls the power supply from the AC power source to the fixing unit based on the zero crossing information.

23. The image formation apparatus according to claim 22 wherein, the control unit controls turning on/off of the power supply to the fixing unit based on the zero crossing information.

24. The image formation apparatus according to claim 22 wherein, the control unit controls the turning on/off of the power supply to the fixing unit based on a phase control using the zero crossing information.

25. An information deriving method comprising:

obtaining a voltage waveform of an AC power source during a predetermined period following activation of the AC power source and not obtaining the voltage waveform after the predetermined period; and deriving zero crossing information based on the voltage waveform obtained.

26. A computer program that makes a computer execute:

obtaining a voltage waveform of an AC power source during a predetermined period following activation of the AC power source and not obtaining the voltage waveform after the predetermined period; and deriving zero crossing information based on the voltage waveform obtained.

* * * * *